US008276558B2

(12) United States Patent
Ottersbach et al.

(10) Patent No.: US 8,276,558 B2
(45) Date of Patent: Oct. 2, 2012

(54) DEVICE FOR VARIABLY ADJUSTING THE CONTROL TIMES OF GAS-EXCHANGE VALVES OF AN INTERNAL COMBUSTION ENGINE

(75) Inventors: Rainer Ottersbach, Aurachtal (DE); Juergen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 257 days.

(21) Appl. No.: 12/425,465

(22) Filed: Apr. 17, 2009

(65) Prior Publication Data

US 2009/0260589 A1 Oct. 22, 2009

(30) Foreign Application Priority Data

Apr. 19, 2008 (DE) ..... 10 2008 019 747

(51) Int. Cl.
*F01L 1/34* (2006.01)

(52) U.S. Cl. ..... 123/90.17

(58) Field of Classification Search ..... 123/90.15, 123/90.17; 74/568 R
See application file for complete search history.

(56) References Cited

U.S. PATENT DOCUMENTS

| | | | | |
|---|---|---|---|---|
| 7,841,311 | B2 * | 11/2010 | Hutcheson et al. | 123/90.17 |
| 2003/0051686 | A1 * | 3/2003 | Trappe et al. | 123/90.17 |
| 2007/0272184 | A1 * | 11/2007 | Rommel et al. | 123/90.17 |
| 2008/0257104 | A1 * | 10/2008 | Lancefield et al. | 74/568 R |
| 2009/0183702 | A1 * | 7/2009 | Knecht et al. | 123/90.15 |

* cited by examiner

*Primary Examiner* — Thomas Denion
*Assistant Examiner* — Daniel Bernstein
(74) *Attorney, Agent, or Firm* — Lucas & Mercanti, LLP; Klaus P. Stoffel

(57) ABSTRACT

A device for variably adjusting the control times of gas-exchange valves of an internal combustion engine. The device has a drive input element and a drive output element, The drive input element is placed in driving connection with a crankshaft of the internal combustion engine, the drive output element is arranged so as to be pivotable with respect to the drive input element, and the device is fastened to a camshaft which has a hollow shaft and an inner shaft which is arranged concentrically with respect to the hollow shaft. An improved mounting arrangement of the concentrically arranged shafts with respect to one another is proposed.

2 Claims, 3 Drawing Sheets

DEVICE FOR VARIABLY ADJUSTING THE CONTROL TIMES OF GAS-EXCHANGE VALVES OF AN INTERNAL COMBUSTION ENGINE

This application claims the priority of DE 10 2008 019 747.5 filed Apr. 19, 2008, which is incorporated by reference herein.

FIELD OF THE INVENTION

The invention relates to a device for variably adjusting the control times of gas-exchange valves of an internal combustion engine, having a drive input element and at least one drive output element, with it being possible for the drive input element to be placed in driving connection with a crankshaft of the internal combustion engine, with the drive output element being arranged so as to be pivotable with respect to the drive input element, and with it being possible for the device to be fastened to a camshaft which comprises at least one hollow shaft and an inner shaft which is arranged concentrically with respect to said hollow shaft.

BACKGROUND OF THE INVENTION

In modern internal combustion engines, use is made of devices for variably adjusting the control times of gas-exchange valves in order to be able to variably adjust the phase relationship between a crankshaft and a camshaft or at least one cam of a camshaft in a defined angle range between a maximum early position and a maximum late position. For this purpose, the device is integrated into a drivetrain which serves to transmit torque from the crankshaft to the camshaft. Said drivetrain may for example be realized as a belt drive, chain drive or gearwheel drive. Here, devices are known which act on the phase position of all cams of a camshaft. Devices are likewise known which are attached to a camshaft and which are composed of an outer hollow shaft and an inner shaft which is arranged concentrically with respect to said hollow shaft. In this context, a first group of cams is rotationally fixedly connected to the hollow shaft while a second group of cams is rotationally fixedly connected to the inner shaft. In this embodiment, the device may for example act on only one of the two groups, while the phase position of the other cams remains constant. Devices are likewise conceivable which make it possible to vary the phase positions of both groups of cams independently of one another.

DE 10 2005 014 680 A1 discloses an adjustable camshaft, at the two ends of which is arranged a device for variably adjusting the control times of gas-exchange valves. The adjustable camshaft is composed of shafts which are mounted concentrically one inside the other and which can be adjusted relative to one another in terms of rotational angle and which are drive-connected to at least one of the devices each.

A disadvantage of said embodiment is that the mounting of the concentrically arranged shafts with respect to one another takes place directly via the shafts. For this purpose, complex and expensive machining steps are required, for example on an inner lateral surface of the outer hollow shaft and on a counterpart bearing point, which is aligned with fitting accuracy with respect to said inner lateral surface, on the inner shaft.

OBJECT OF THE INVENTION

The object on which the invention is based is that of creating a device for variably adjusting the control times of gas-exchange valves of an internal combustion engine, wherein it is sought to simplify the mounting of the concentrically arranged shafts with respect to one another.

The object is achieved according to the invention in that two radial bearing points are formed on one of the components of drive output element or drive input element, with the first radial bearing point being provided for mounting the hollow shaft and the second radial bearing point being provided for mounting the inner shaft.

The device has at least one drive input element and at least one drive output element. In the assembled state of the device, the drive input element is drive-connected to the crankshaft for example via a traction mechanism drive or gearwheel drive. The drive output element or drive output elements are arranged so as to be pivotable relative to the drive input element in an angle range. Furthermore, an actuating mechanism is provided, by means of which the pivoting movement can be generated. Said actuating mechanism may for example be designed as a hydraulic actuating mechanism (for example vane-type mechanism) or electromechanical actuating mechanism (for example by means of a planetary gear set or three-shaft gearing with one of the shafts being driven by an electric motor). The drive output element is rotationally fixedly connected to a camshaft which has cams which actuate the gas-exchange valves of an internal combustion engine.

The camshaft is composed of at least two shafts which are arranged concentrically with respect to one another, for example a hollow shaft and an inner shaft which is arranged in said hollow shaft. A first group of cams is rotationally fixedly connected to the hollow shaft and a second group of cams is rotationally fixedly connected to the inner shaft.

The drive output element may be rotationally fixedly connected to the inner or outer shaft, as a result of which the phase position of said shaft relative to the drive input wheel can be variably adjusted. In the context, the drive input element may be connected to the other shaft, or a further drive output element may be provided which is connected to the other shaft, as a result of which the phase position of the two shafts can be adjusted, independently of one another, with respect to the drive input wheel.

Instead of the direct mounting of the hollow shaft with respect to the inner shaft as described in the prior art, that is to say instead of providing radial bearing points at least at both ends of the inner shaft and of the hollow shaft, which radial bearing points interact with the bearing points of the other shaft, it is provided that the mounting of the inner shaft with respect to the hollow shaft at the device side is realized by means of radial bearing points which are formed on precisely one component of the device. Said component may also be a multi-part component if the components in which the bearing points are formed are not movable relative to one another.

The radial bearing points which are complementary thereto are formed on the inner shaft or the hollow shaft. Said complementary radial bearing points are advantageously formed on the outer lateral surfaces of the inner shaft and of the hollow shaft, as a result of which the machining expenditure is minimized. The formation of the radial bearing points on the component of the device does not increase the production costs or production expenditure, since said components are conventionally produced from sintered material and must therefore be finish-machined after the shaping process anyway.

In this context, it may be provided that the first and the second radial bearing points are formed on the drive output element. It is likewise conceivable for said radial bearing points to be formed on the drive input element.

In one refinement of the invention, it is provided that the first and the second radial bearing points are formed on an inner lateral surface of the component. The inner lateral surface advantageously has at least two cylindrical regions of different diameter, with the first radial bearing point being formed on the first cylindrical region and the second radial bearing point being formed on the second cylindrical region. The step which is formed in this way may therefore serve as an axial bearing for one of the two shafts.

In one refinement of the invention, it is provided that a third radial bearing point is formed on the other component (that component from the group comprising the drive output element and the drive input element on which the first two radial bearing points are not formed), which third radial bearing point is provided for mounting the hollow shaft or the inner shaft. The radial position of the inner shaft with respect to the hollow shaft is therefore defined by the common mounting in the same component. The radial position of the drive output element with respect to the drive input element is simultaneously defined by the mounting of at least one of said shafts in the other component. In this way, the smooth running of the device is increased, as a result of which the service life of components of the device, for example sealing strips and the springs thereof which are attached to a piston or to a vane, is considerably increased. Furthermore, wear to the drive input element and/or the drive output element is reduced.

A radial bearing point is to be understood within the context of the present invention to mean surfaces which define the radial position of the component which interacts therewith. Consideration may be given here for example to rotationally fixed connections such as for example an interference fit. Furthermore, a radial bearing point may also be understood to mean a closely toleranced clearance fit, with it being possible, despite the radial fixing of the positions of the components with respect to one another, for a pivoting movement and/or an axial movement to take place between said components.

BRIEF DESCRIPTION OF THE DRAWINGS

Further features of the invention can be gathered from the following description and from the drawings, in which an exemplary embodiment of the invention is illustrated in simplified form. In the drawing.

DETAILED DESCRIPTION OF THE DRAWINGS

Figure 1:
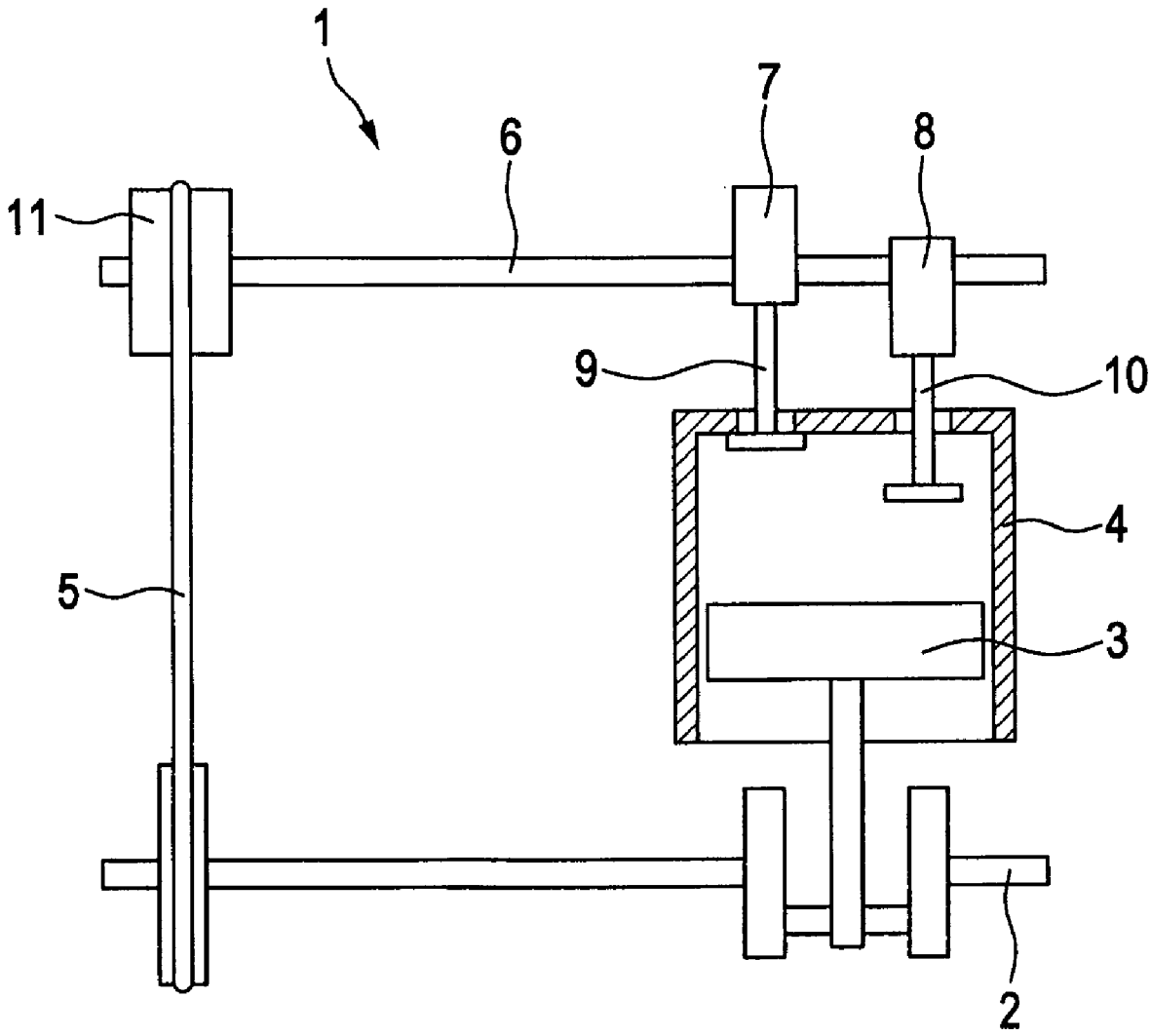
FIG. 1 shows, merely in very schematic form, an internal combustion engine.
Figure 2:
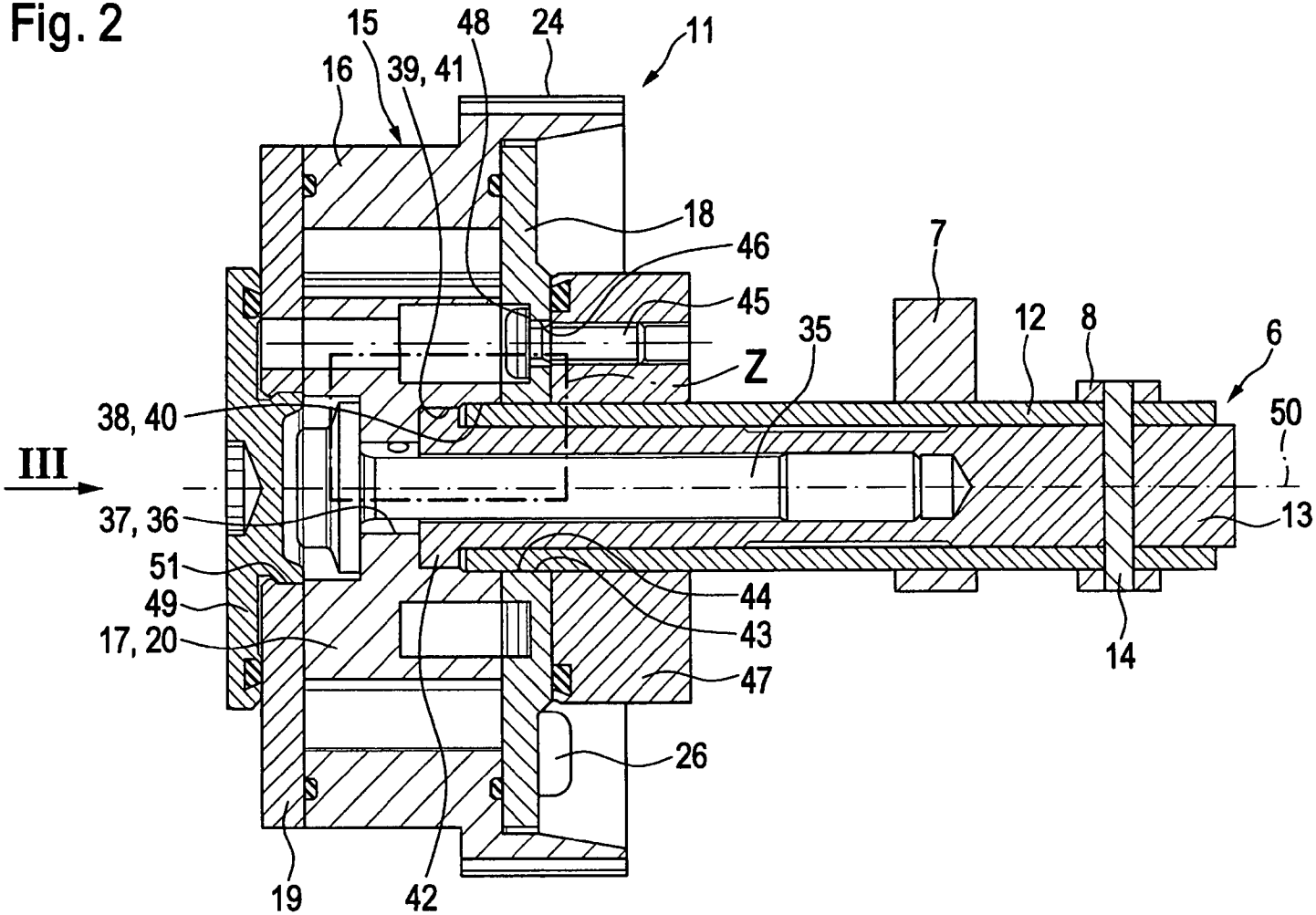
FIG. 2 shows a longitudinal section through an embodiment according to the invention of a device for variably adjusting the control times of gas-exchange valves of an internal combustion engine.

FIG. 1 depicts an internal combustion engine 1, with a piston 3, which is seated on a crankshaft 2, being shown in a cylinder 4. In the illustrated embodiment, the crankshaft 2 is drive-connected by means of a traction mechanism drive 5, for example a chain drive or belt drive, to a camshaft 6. Alternatively, the traction mechanism drive 5 may be replaced by a gearwheel drive. At least one first and one second cam 7, 8 is arranged on the camshaft 6. The camshaft 6 is composed, as illustrated in FIG. 2, of a hollow shaft 12 and a shaft 13 which is arranged in the hollow shaft 12, with the shaft 13 being arranged concentrically with respect to the hollow shaft 12. The cams 7, 8 are arranged on the outer lateral surface of the hollow shaft 12. In this context, the first cams 7 are rotationally fixedly connected to the hollow shaft 12, while the second cams 8 are rotatably mounted on said hollow shaft 12. Furthermore, a rotationally fixed connection is produced between the second cams 8 and the shaft 13, such that they rotate as a unit. For this purpose, a driving member, a pin 14 in the illustrated embodiment, is provided, which driving element rotationally fixedly connects the shaft 13 to the second cam 8. The pin 14 extends through the shaft 13 perpendicularly with respect to the rotational axis 50 of said shaft 13 and is connected to the shaft 13. In the region of the pin 14, the hollow shaft 12 is provided with an opening through which the pin 14 extends. Those regions of the pins 14 which project out of the hollow shaft 12 engage into receiving openings which are formed on an inner lateral surface of a bore of the second cams 8, as a result of which a rotationally fixed connection is produced between the pins 14 and the second cam 8. The openings of the hollow shaft 12 are formed so as to be larger in the circumferential direction than the outer contour of the pins 14, such that the second cams 8 are mounted in a rotatable manner on the hollow shaft 12.

The cams 7, 8 of the camshaft 6 each actuate one gas-exchange valve 9, 10, for example an inlet gas-exchange valve 9 or an outlet gas-exchange valve 10. In general, a plurality of first cams 7 and a plurality of second cams 8 are arranged on the camshaft 6. In this context, the one group of cams 7, 8 (the first or the second cams 7, 8) acts on inlet gas-exchange valves 9, while the other group of cams 7, 8 acts on outlet gas-exchange valves 10.

The drive of the camshaft 6 by means of the traction mechanism drive 5 takes place via a device 11 for variably adjusting the control times of gas-exchange valves 9, 10 of an internal combustion engine 1. The device 11 is arranged at the drive-side end of the camshaft 6 and makes it possible, as explained below, to vary the phase position between the crankshaft 2 and the hollow shaft 12 or the inner shaft 13.

Alternatively, the device 11 may also be designed such that the phase positions of the hollow shaft 12 and of the inner shaft 13 are variable with respect to one another and with respect to the crankshaft 2.

FIG. 2 shows a device 11 according to the invention in a longitudinal section. The device 11 has a drive input element 15 and a drive output element 17. The drive input element 15 is composed of a housing 16 and two side covers 18, 19 which are arranged on the axial side surfaces of the housing 16.

Figure 3:
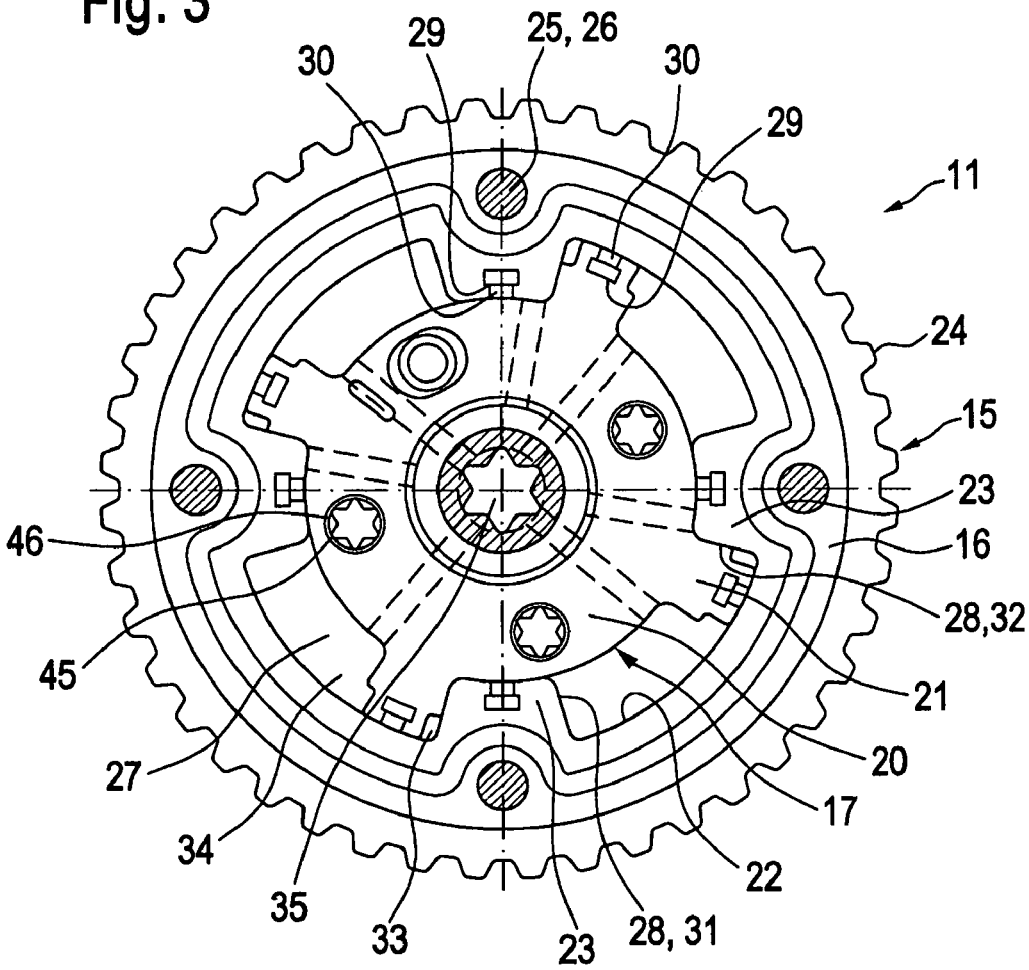
FIG. 3 shows the device from FIG. 2 in the plan view along the arrow III.

FIG. 3 shows the device 11 according to the invention in a plan view, with only the drive input element 15 and the drive output element 17 being illustrated. The drive output element 17 is designed in the manner of a vane wheel and has a substantially cylindrical hub element 20, from the outer cylindrical lateral surface of which four vanes 21 extend outward in the radial direction. In the illustrated embodiment, the vanes 21 are formed in one piece with the hub element 20. Likewise conceivable are separate vanes 21 which are for example arranged in vane grooves of the hub element 20.

Proceeding from an outer peripheral wall 22 of the housing 16, a plurality of side walls 23 extend radially inward. In the illustrated embodiment, the side walls 23 are formed in one piece with the peripheral wall 22. The drive input element 15 is arranged within the housing 16 so as to be rotatable with respect to the latter.

A drive input wheel, a belt pulley 24 in the illustrated embodiment, is arranged on an outer lateral surface of the peripheral wall 22, via which drive input wheel torque can be transmitted, by means of a belt drive (not illustrated), from the crankshaft 2 to the drive input element 15. In the illustrated embodiment, the drive input wheel is formed in one piece with the housing 16. Likewise conceivable are embodiments in which the drive input wheel is formed in one piece with one of the side covers 18, 19 or as a separate component. Sprockets or gearwheels are also conceivable in addition to the illustrated belt pulley 24.

One of the side covers 18, 19 is arranged on each one of the axial side surfaces of the housing 16 and is rotationally fixed to said housing 16. For this purpose, four axial openings 25 are provided on the housing 16, which axial openings 25 are aligned with axial openings of the side covers 18, 19. One bolt 26 each, a screw in the illustrated embodiment, engages through aligned axial openings 25 of the housing 16 and of the side covers 18, 19, and said bolts 26 thereby produce the rotationally fixed connection of the components.

Within the device 11, a pressure chamber 27 is formed between two side walls 23 which are adjacent in the circumferential direction. Each of the pressure chambers 27 is delimited in the circumferential direction by opposing, substantially radially running delimiting walls 28 of adjacent side walls 23, in the axial direction by the side covers 18, 19, in the radially inward direction by the hub element 20, and in the radially outward direction by the peripheral wall 22. A vane 21 projects into each of the pressure chambers 27, wherein the vanes 21 are designed so as to bear, aside from tolerances, both against the side covers 18, 19 and also against the peripheral wall 22. An axial groove 29 is formed at the radially outer end of each vane 21, in which axial groove 29 is arranged a sealing body 30. The sealing body 30 is pressed in the radial direction against the peripheral wall 22 by an elastic means, as a result of which leakage between the upper end of the vanes 21 and the peripheral wall 22 is minimized. Each vane 21 thereby separates the respective pressure chamber 27 into two oppositely acting pressure chambers 33, 34. Similarly, sealing strips 30 which are likewise spring-loaded are arranged in the side walls 23, which sealing strips 30 are pressed radially inward against the hub element 20.

The drive output element 17 is arranged so as to be rotatable with respect to the drive input element 15 in a defined angle range. The angle range is limited in one rotational direction of the drive output element 17 by virtue of the vanes 21 coming to each bear against one corresponding delimiting wall 28 (early stop 31) of the pressure chambers 27. Similarly, the angle range is limited in the other rotational direction by virtue of the vanes 21 coming to bear against the other delimiting walls 28, which serve as a late stop 32, of the pressure chambers 27.

By pressurizing one group of pressure chambers 33, 34 and relieving the other group of pressure, it is possible to vary the phase position of the drive input element 15 with respect to the drive output element 17. By pressurizing both groups of pressure chambers 33, 34, it is possible for the phase position to be held constant.

The hollow shaft 12 and the inner shaft 13 extend through the first side cover 18 and extend into a central bore 36 of the drive output element 17. Two radial bearing points 38, 39 are formed on an inner lateral surface 37 of the central bore 36, which radial bearing points 38, 39 serve for mounting the hollow shaft 12 and the inner shaft 13. The inner diameter of the first radial bearing point 38 is matched to the outer diameter of the hollow shaft 12 in the region of the bearing point. The inner diameter of the second radial bearing point 39 is matched in terms of outer diameter to the inner shaft 13 in the region of the bearing point. The relative radial positions of the hollow shaft 12 and of the inner shaft 13 with respect to the drive output element 17 and of the shafts 12, 13 with respect to one another are thereby defined by the radial bearing points 38, 39. Furthermore, it is possible to dispense with a direct radial bearing point between the hollow shaft 12 and the inner shaft 13 at said axial end of the camshaft 6. Only one direct radial bearing point is required between the hollow shaft 12 and the inner shaft 13, for example at those ends (not illustrated) of said hollow shaft 12 and inner shaft 13 which face away from the device 11. The formation of direct bearing points between the hollow shaft 12 and the inner shaft 13 is very complex and expensive. In contrast, the formation of the radial bearing points 38, 39 on the inner lateral surface 37 of the bore 36 can be realized in a cost-effective manner. The drive output element 17 is conventionally produced by means of a sintering process, as a result of which finish-machining of the inner lateral surface 37 must be carried out in any case. The formation of the radial bearing points 38, 39 therefore does not entail any additional costs. A further advantage results from the porosity of the sintered material, as a result of which the lubrication of the radial bearing points 38, 39 is considerably improved.

Figure 4:
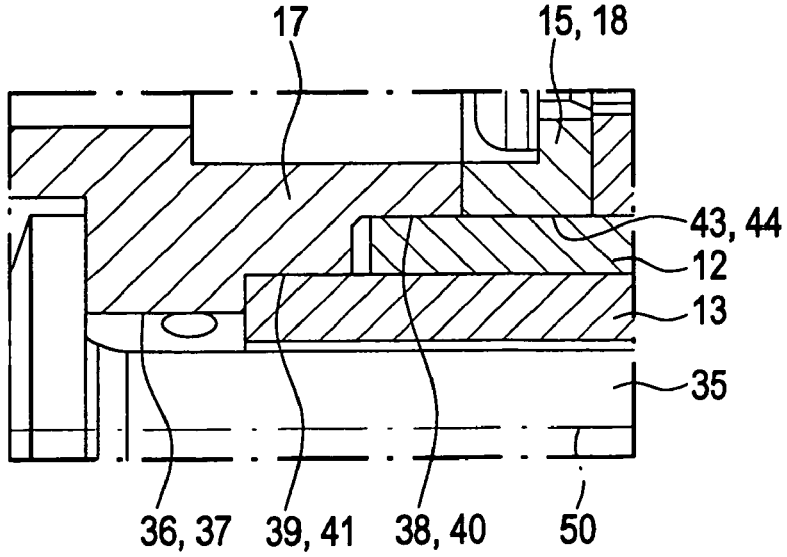
FIG. 4 shows the detail Z from FIG. 2 in a slightly modified form.

The inner lateral surface 37 is of stepped design in longitudinal section, as a result of which two cylindrical regions 40, 41 of different inner diameter are formed. In the process, the first cylindrical region 40 serves to form the first radial bearing point 38 and the second cylindrical region 41 serves to form the second radial bearing point 39. The step formed by the cylindrical regions 40, 41 may be utilized as an axial stop for the hollow shaft 12. Furthermore, it is possible to dispense with the formation of a shoulder 42 of increased diameter on the inner shaft 13 (illustrated in FIG. 4).

In the illustrated embodiment, the first side cover 18 is provided with a first central opening 43 through which the hollow shaft 12 and the inner shaft 13 extend. A third radial bearing point 44 is formed on the inner lateral surface of the first central opening 43, which third radial bearing point 44 serves for mounting the hollow shaft 12. The inner diameter of the third radial bearing point 44 is matched to the outer diameter of the hollow shaft 12 in the region of the bearing point. Since the hollow shaft 12 is mounted in the radial direction in a bearing point of the drive output element 17 on the one hand and in a bearing point of the drive input element 15 on the other hand, the radial positioning of the drive input element 15 with respect to the drive output element 17 is defined. A radial movement of the drive input element 15 with respect to the drive output element 17 is therefore minimized by means of a short tolerance chain, as a result of which a radial movement of the sealing bodies 30 in the axial grooves 29 is likewise minimized. The loading of the elastic elements which act on the sealing bodies 30 is therefore minimized, and the service life of said elastic elements is thereby increased.

In an alternative embodiment, it is of course also possible for the first and second radial bearing points 38, 39 to be formed on the drive input element 15 and for the third radial bearing points 44 to be formed on the drive output element 17. For this purpose, it could for example be provided to design the first side cover 18 to be wider or to provide said first side cover 18 with a flange, so as to provide sufficient space for the first and second radial bearing points 38, 39. Likewise conceivable is an embodiment in which the first radial bearing point 38 is formed on the first side cover 18, the second radial bearing point 39 is formed on the second side cover 19 and the third radial bearing point 44 is formed on the drive output element 17. Here, the hollow shaft 12 or the inner shaft 13 may be mounted on the third radial bearing point 44.

The drive output element 17 is rotationally fixedly connected to the shaft 13 by means of a central screw 35. The central screw 35 extends through the central bore 36 of the drive output element 17, with the screw head of said central screw 35 bearing against an axial contact surface, which faces away from the shaft 13, of the drive output element 17. A thread section of the central screw 35 engages into the shaft 13 so as to produce a screw connection.

The drive input element 15 is rotationally fixedly connected to the hollow shaft 12 by means of three screws 45. The screws 45 extend through one opening 46 each which are formed on the first side cover 18. The head of the screw 45 bears against that side of the first side cover 18 which faces towards the hub element 20. The other end of the screw 45 engages into a connecting flange 47 which is rotationally fixedly connected to the hollow shaft 12. The connecting flange 47 may for example be formed in one piece with the hollow shaft 12. In the illustrated embodiment, the connecting flange 47 is formed as a separate component and is rotationally fixedly connected to the hollow shaft 12, for example in a form-fitting, force-fitting or cohesive manner.

In the illustrated embodiment, the hollow shaft 12 must be mounted so as to be pivotable with respect to the drive output element 17. This bearing point may therefore be designed, for example, as a closely toleranced clearance fit. The inner shaft 13 is rotationally fixedly connected to the drive output element 17. In addition to a closely toleranced clearance fit, an interference fit at the second radial bearing point 39 would for example also be conceivable. The same applies to the mounting of the hollow shaft 12 at the third radial bearing point 44, since the hollow shaft 12 is rotationally fixedly connected to the drive input element 15 (the first side cover 18).

The first side cover 18 is of wider design in the axial direction in the region of the openings 46 than the rest of the first side cover 18. Here, a receptacle 48 is formed in the first side cover 18 on the side of the drive output element 17, which receptacle 48 adjoins the opening 46. The receptacle 48 is designed such that the screw head of the screw 45 can be fully sunk into said receptacle 48.

A second central opening 51 which is formed on the second sealing cover 19 is closed off in a pressure-medium-tight manner by means of a closure cover 49.

The mode of operation of the device 11 is described below. Torque is transmitted via the belt pulley 24 from the crankshaft 2 to the drive input element 15 and therefore to the first side cover 18, to the connecting flange 47 and therefore to the hollow shaft 12. This constitutes a direct connection between the crankshaft 2 and the hollow shaft 12 or the first cams 7; a variation of the phase position is not possible.

By means of the pressure prevailing in the pressure chambers 33, 34, the torque of the crankshaft 2 is also transmitted via the drive input element 15 to the drive output element 17 and therefore to the shaft 13 and the second cams 8. By pressurizing the one group of pressure chambers 33, 34 while simultaneously evacuating the other group of pressure chambers 34, 33, it is possible to vary the phase position of the drive output element 17 relative to the drive input element 15, and therefore of the shaft 13 with respect to the crankshaft 2. By pressurizing both groups of pressure chambers 33, 34, it is possible to obtain a constant phase position between the shaft 13 and the crankshaft 2.

LIST OF REFERENCE SYMBOLS

1 Internal combustion engine
2 Crankshaft
3 Piston
4 Cylinder
5 Traction mechanism drive
6 Camshaft
7 First cam
8 Second cam
9 First gas-exchange valve
10 Second gas-exchange valve
11 Device
12 Hollow shaft
13 Shaft
14 Pin
15 Drive input element
16 Housing
17 Drive output element
18 Side cover
19 Side cover
20 Hub element
21 Vane
22 Peripheral wall
23 Side wall
24 Belt pulley
25 Axial opening
26 Bolt
27 Pressure chamber
28 Delimiting wall
29 Axial groove
30 Sealing body
31 Early stop
32 Late stop
33 First pressure chamber
34 Second pressure chamber
35 Central screw
36 Bore
37 Inner lateral surface
38 First radial bearing point
39 Second radial bearing point
40 First cylindrical region
41 Second cylindrical region
42 Shoulder
43 First central opening
44 Third radial bearing point
45 Screw
46 Opening
47 Connecting flange
48 Receptacle
49 Closure cover
50 Rotational axis
51 Second central opening

The invention claimed is:

1. A device for variably adjusting control times of gas-exchange valves of an internal combustion engine, which has a crankshaft, the device comprising:

a drive input element drive-connectable to the crankshaft;

at least one drive output element housed inside the drive input element and pivotable with respect to the drive input element; and a camshaft connectable to the gas-exchange valves and to the drive output element, the camshaft having at least one hollow shaft, which has an inner face and an inner shaft, which has a rotational axis and an outer circumferential surface arranged concentrically with respect to the hollow shaft, the outer circumferential surface being substantially in direct contact with the inner face of the hollow shaft and the inner shaft extending toward the drive output element axially beyond the hollow shaft and radially outwardly beyond the inner face of the hollow shaft, wherein two directly adjacent radial bearing points are formed on an inner lateral surface of the drive output element, the inner lateral surface has a first cylindrical region and a second cylindrical region of different diameters with a first of the radial bearing points being formed on the first cylindrical region and a second of the bearing points being formed on the second cylindrical region, the first of the radial bearing points being in contact with the hollow shaft and the second of the radial bearing points being in contact with the inner shaft.

2. The device according to claim 1, wherein a third radial bearing point is formed on the drive input clement, the third radial bearing point is provided for mounting the hollow shaft or the inner shaft.

* * * * *